US006966101B2

(12) United States Patent
Chiang

(10) Patent No.: US 6,966,101 B2
(45) Date of Patent: Nov. 22, 2005

(54) HANDLE OF A GLASS DOOR

(75) Inventor: Fanny Chiang, Taichung (TW)

(73) Assignee: Door & Window Hardware Co., Taichung (TW)

( * ) Notice: Subject to any disclaimer, the term of this patent is extended or adjusted under 35 U.S.C. 154(b) by 19 days.

(21) Appl. No.: 10/667,429

(22) Filed: Sep. 23, 2003

(65) Prior Publication Data

US 2005/0060844 A1 Mar. 24, 2005

(51) Int. Cl.[7] ..... A45C 3/00
(52) U.S. Cl. ..... 16/412
(58) Field of Search ..... 16/412, 413, 110.1, 16/406, 415, 416, 422–425, 436, 441, 111 R, 16/114 R, DIG. 41; 403/301, 306, 361, 362; 312/244; 49/460, 461; 292/336.3, 198, DIG. 53, 292/DIG. 63

(56) References Cited

U.S. PATENT DOCUMENTS

| | | | | |
|---|---|---|---|---|
| 1,145,471 | A * | 7/1915 | Dobrick | 16/436 |
| 2,576,511 | A * | 11/1951 | Jewett | 16/402 |
| 4,156,794 | A * | 5/1979 | Robinson | 174/16.1 |
| 4,557,467 | A * | 12/1985 | Lin | 256/59 |
| 4,646,491 | A * | 3/1987 | Munch | 52/207 |
| 4,895,399 | A * | 1/1990 | Horgan, Jr. | 292/92 |
| 4,912,809 | A * | 4/1990 | Scheuer | 16/413 |
| 6,250,044 | B1 * | 6/2001 | Funk et al. | 52/782.1 |
| 6,317,930 | B1 * | 11/2001 | Hung | 16/430 |
| 6,463,628 | B1 * | 10/2002 | Yeh | 16/412 |
| 6,502,794 | B1 * | 1/2003 | Ting | 248/206.2 |
| 6,543,089 | B2 * | 4/2003 | Tasman | 16/412 |
| 6,578,235 | B2 * | 6/2003 | Womack et al. | 16/412 |

FOREIGN PATENT DOCUMENTS

JP 10205182 A * 8/1998

* cited by examiner

*Primary Examiner*—Robert J. Sandy
*Assistant Examiner*—Andre' L. Jackson
(74) *Attorney, Agent, or Firm*—Rosenberg, Klein & Lee

(57) ABSTRACT

A handle of a glass door, which is made of such materials as to match glass, e.g. acrylic, includes handle parts, and metallic connecting blocks; each of the handle parts has two folded ends formed with connecting tail end portions; each of the metallic connecting blocks is formed with a holding cavity at a first end thereof, and is fitted over a respective connecting tail end portion of the handle parts at the holding cavity thereof; each handle part has a radial through hole formed across the connecting tail end portion thereof; each connecting block has holes aligned with the radial through hole of a corresponding tail end portion; securing elements are fitted in the holes of the connecting blocks as well as the radial through holes to securely join the connecting blocks to the handle parts.

8 Claims, 8 Drawing Sheets

HANDLE OF A GLASS DOOR

BACKGROUND OF THE INVENTION

1. Field of the Invention

The present invention relates to a handle of a glass door, more particularly one, which is made of acrylic, and which is secured to the glass door in such a manner as to have longer service life, and lower inventory cost, and prevent people from removing it from the outdoor maliciously.

2. Brief Description of the Prior Art

Glass doors are used to allow people inside the room to see outside through them and vice versa. And, glass doors are attractive, and allow sunlight to enter and increase illumination inside the house. Glass doors are usually equipped with handles made of materials that can match glass, e.g. acrylic.

Referring to FIG. 6, a glass door 6 is equipped with acrylic handles 75, 75 on inner and outer sides thereof. Each handle 75 is formed with a straight portion, and two folded portions at two ends. The handles 75, 75 are secured to the glass door 6 such that each of the folded ends of one of the handles opposes one of the folded ends of the other handle. Each of the folded ends of the handles has a metallic protective element 76, which is disposed over a tail end of the folded end, and is secured in position by means of a screw 751; the screw 751 is screwed through the protective element 76, and screwed into the folded end along the axial direction of the folded end. Each of the protective elements 76 has a holding cavity 761, and has radial threaded holes (not numbered) communicating with the holding cavity 761. Truncated-cone shaped engaging blocks 73 are provided, and will be held in respective ones of the holding cavities 761 of the protective elements 76 in combination, each of which truncated-cone shaped engaging blocks 73 has a threaded hole formed through the middle thereof. Two tube-shaped pads 71 are fitted into respective ones of two through holes 61 of the door 6, and ringed pads 72 are secured to the door 6 around two ends of the through holes 61. Two bolts 74 are passed through respective ones of the through holes 61 of the door 6, and screwed into the truncated-cone shaped engaging blocks 73, and threaded fixing elements 762 are screwed into the radial threaded holes of the protective elements 76 to contact the truncated-cone shaped engaging blocks 73; thus, the truncated-cone shaped engaging blocks 73 are blocked from falling off the protective elements 76, and the handles 75, 75 are secured to respective ones of the two sides of the door 6.

The above handles can be easily removed from the outdoor by malicious people because the fixing elements 762 are exposed to outside, and can be easily undone.

To overcome the disadvantage of the above handles 75, referring to FIGS. 7, and 8, outward and inward handles 82, and 86 are provided. The outward handle 82 has protective covers 821 fixedly joined to two folded ends thereof, and axial holes formed at the folded ends, in which metallic tubes 823 are fitted, while the protective covers 821 have holes aligned with the axial holes of the folded ends. Each of the metallic tubes 823 has a threaded inner side 822. The inward handle 86 is the same as the last handles 75, having metallic protective elements 87 joined to two folded ends thereof, each of which is formed with a holding cavity 871, and radial threaded holes communicating with the holding cavity 871.

In combination, bolts 83 are screwed through, from inward side of the door 6, truncated-cone shaped engaging blocks 84, ringed pads 85, tube-shaped pads 81 fitted in through holes of the door 6, ringed pads 824, and screwed into the metallic tubes 823 of the outward handle 82; thus, the outward handle 82 is secured to the outward side of the door 6. Then, the metallic protective elements 87 of the inward handle 86 are fitted over the engaging blocks 84 at the holding cavities 871 thereof, and fixing elements 872 are screwed into the radial threaded holes of the protective elements 87 to engage the engaging blocks 84; thus, the inward handle 86 is secured to the door 6. There is no screws exposed to outside on the outward handle 82 therefore the handle 82 is protected from being removed from the door 6 by malicious people.

However, the above acrylic handles 75, 82, and 86 are likely to be damaged or crack over time because the screws that connect the handles to the protective elements are screwed into the folded ends along the axial direction of the folded ends instead of radial direction of the folded ends due to force exerted to pull the handles to open the door 6.

SUMMARY OF THE INVENTION

It is a main object of the present invention to provide a handle of a glass door to overcome the above disadvantages.

The handle includes handle parts, each of which has two folded ends formed with connecting tail end portions; metallic connecting blocks is used to protect the tail end portions, each which is formed with a holding cavity at a first end thereof, and is fitted over a respective connecting tail end portion at the holding cavity; each handle part has a radial through hole formed across the connecting tail end portion thereof; the connecting blocks have holes aligned with the radial through holes; securing elements are fitted in the holes of the connecting blocks as well as the radial through holes to securely join the connecting blocks to the handle parts. Protective tubes are fitted over the connecting blocks to preventing the securing elements from being maliciously undone. The securing elements are passed into the connecting tail ends of the handle parts in the radial direction of the connecting tail ends instead of the axial direction therefore the handles won't be easily damaged or crack due to force exerted to pull the handles to open the door.

Metallic connecting blocks of present invention are all in the different forms, handles of the present invention are all in the same form, and a door can be easily equipped with handles arranged in desired one of various different positions according to needs with the help of the metallic connecting blocks, the securing elements, and bolts.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
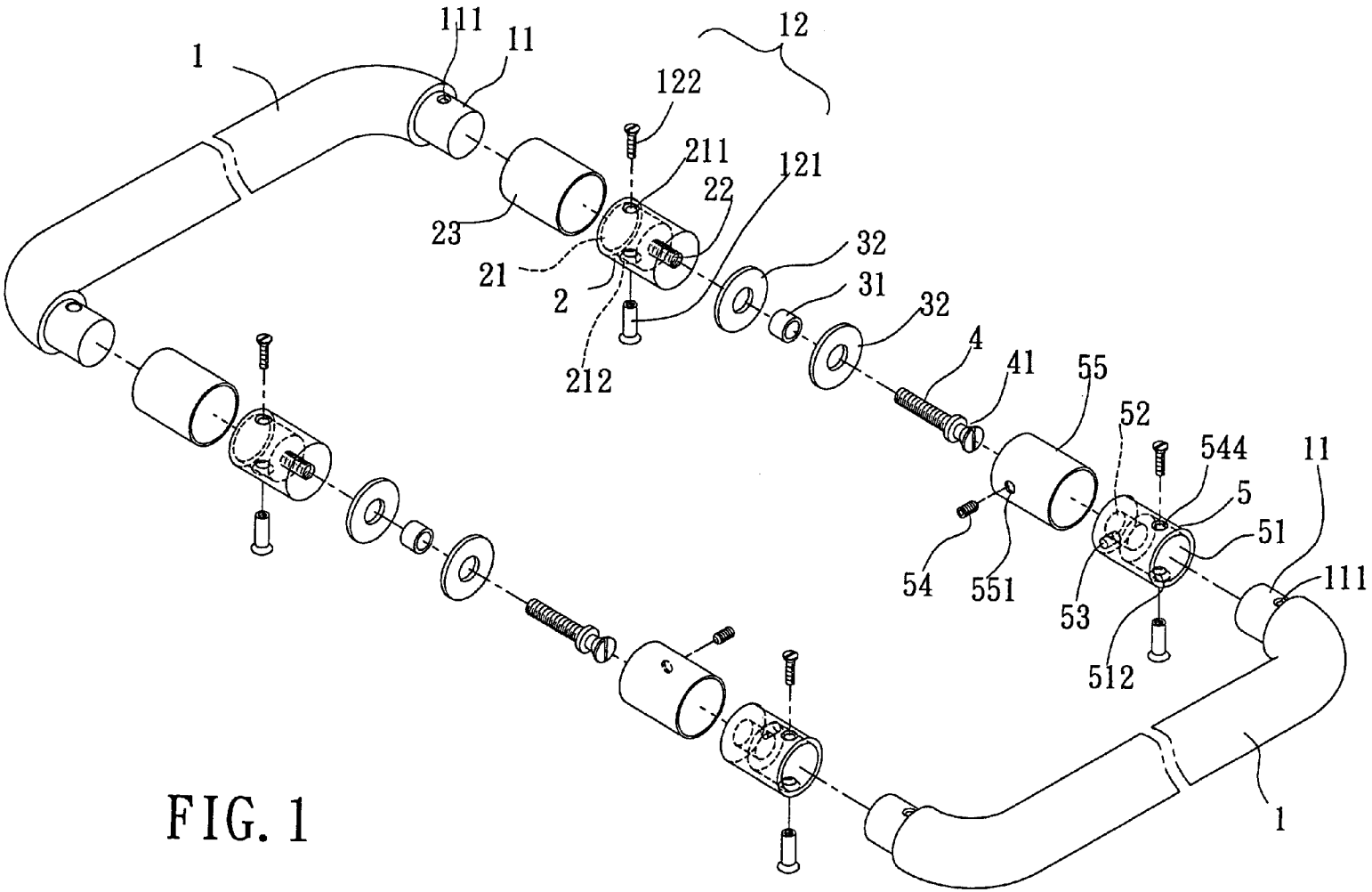
FIG. 1 is an exploded perspective view of the acrylic handle of a glass door according to the present invention.

Referring to FIG. 1, a preferred embodiment of a handle set of a glass door in the present invention includes inward and outward handles 1, 1, metallic connecting blocks 2 for the outward handle part 1, supplementary elements 12, bolts 4, and metallic connecting blocks 5 for the inward handle part 1.

Each of the handle parts 1, 1 has a middle portion, and two folded ends; the folded ends each has a connecting tail end 11, which is made thinner than other portions of the handle parts 1 and formed with a radial through hole 111.

Each of the metallic connecting blocks 2 has a holding cavity 21 at a first end, a threaded hole 22 communicating with the holding cavity 21 at a second end, and aligned through holes 211 and 212 extending from the outer side to the holding cavity 21 thereof. The metallic connecting blocks 2 are fitted over respective ones of the connecting tail ends 11 of the outward handle part 1 at the holding cavities 21 thereof, and securing members 12 are used to secure respective connecting blocks 2 to the outward handle part 1; the securing members 12 each consists of a female screw 121, and a male screw 122; the female screws 121 are passed through the through holes 212, and into the radial through holes 111 while the male screws 122 are passed through the through holes 211, and into the radial through holes 111, and are screwed into the corresponding female screws 121 so that the connecting blocks 2 are fixedly joined to the outward handle part 1. Protective tubes 23 are closely fitted around the metallic connecting blocks 2 so that the securing members 12 are prevented from being exposed to outside.

Each of the metallic connecting blocks 5 has a holding cavity 51 at a first end, a holding hole 52 communicating with the holding cavity 51 at a second end, aligned through holes 511 and 512 extending from an outer side to the holding cavity 51 thereof, and threaded holes 53 extending from an outer side to the holding hole 52 thereof. The metallic connecting blocks 5 are fitted over respective ones of the connecting tail ends 11 of the inward handle part 1 at the holding cavities 51 thereof, and securing members (not numbered) are used to secure respective connecting blocks 5 to the inward handle part 1; the securing members each consists of a female screw, and a male screw; the female screws are passed through the through holes 512, and into the radial through holes 111 while the male screws are passed through the through holes 511, and into the radial through holes 111, and are screwed into the corresponding female screws so that the connecting blocks 5 are fixedly joined to the inward handle 1. Protective tubes 55 are closely fitted around the metallic connecting blocks 5, and the securing members 12 are covered by means of the protective tubes 55. The protective tubes 55 each has through holes 551 extending from an outer side to the middle space thereof; the through holes 551 are aligned with respective ones of the threaded holes 53 of the connecting blocks 5.

Each of the bolts 4 is further formed with an annular engaging projection 41 between the threaded portion and the head thereof.

Figure 2:
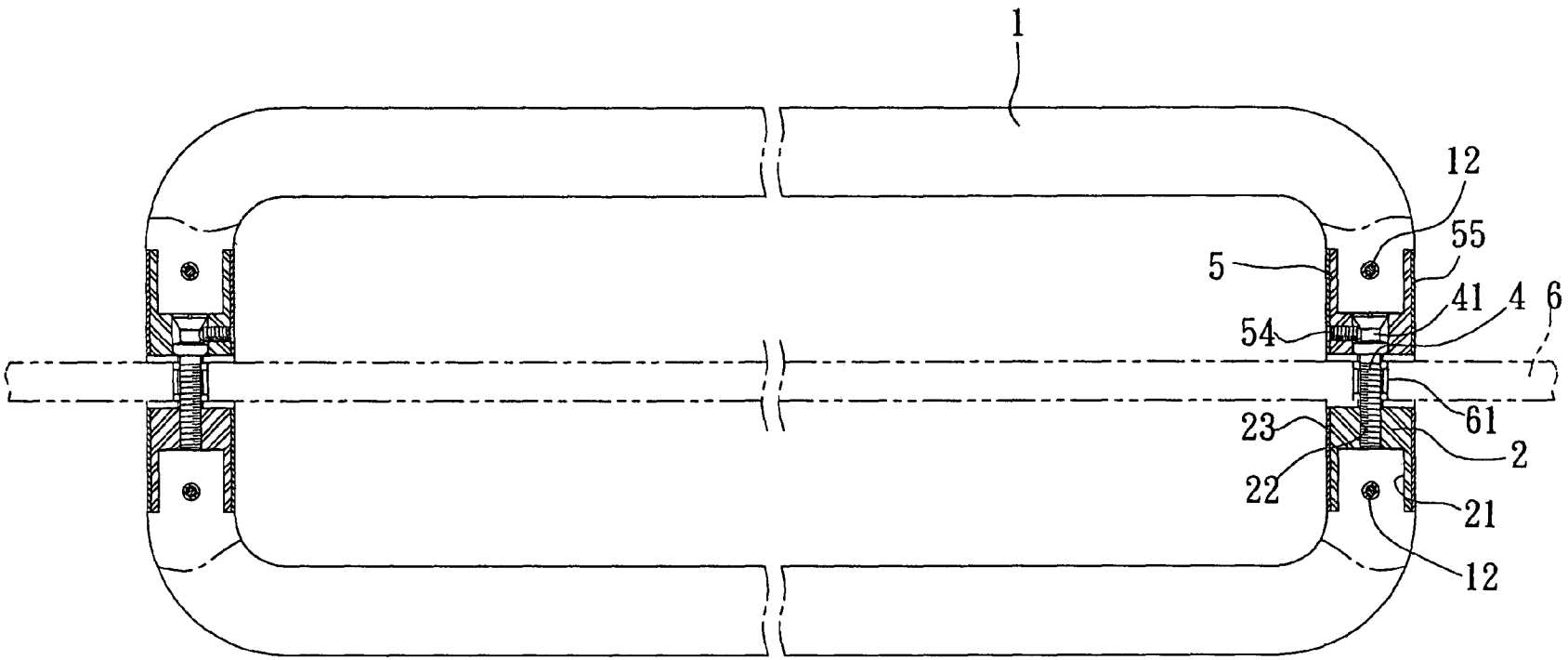
FIG. 2 is a horizontal section of the acrylic handle of a glass door according to the present invention.

In combination, referring to FIGS. 1, and 2, the bolts 4 are passed through ringed pads 32, tube-shaped pads 31 fitted in through holes of a door 6, and ringed pads 32 in sequence, and screwed into the threaded holes 22 of the connecting blocks 2 of the outward handle part 1; thus, the outward handle part 1 is secured to the outward side of the door 6. Then, the inward handle 1 coupled with the metallic connecting blocks 5 are fitted over the heads and the annular engaging projections 41 of the bolts 4 at the holding holes 52 while threaded fixing elements 54 are screwed through the through holes 551 of the protective tubes 55, and screwed into the threaded holes 53 of the connecting blocks 5 to engage the annular engaging projections 41 of the bolts 4; thus, the inward handle part 1 is secured to the door 6.

Figure 3:
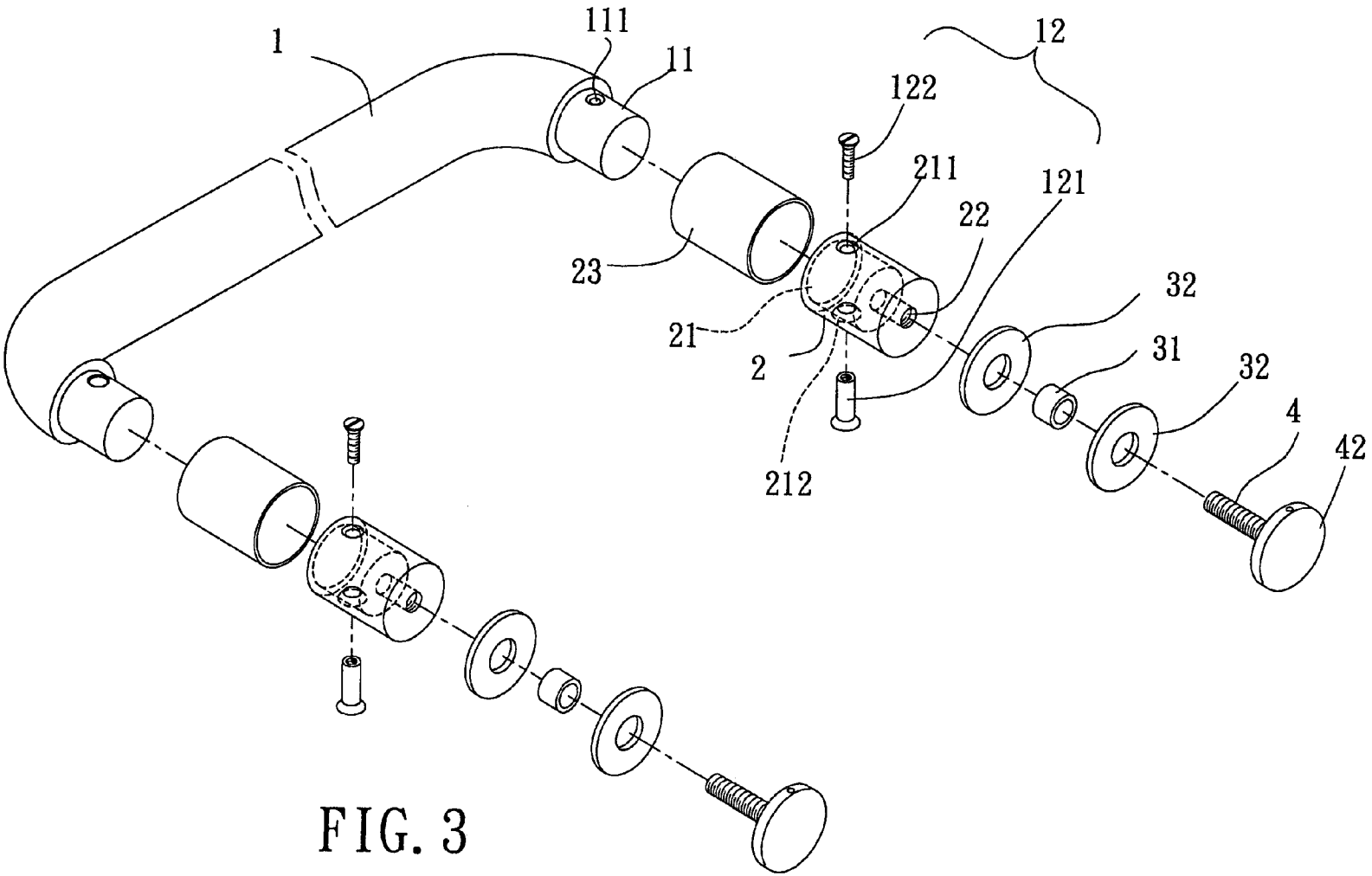
FIG. 3 is an exploded perspective view of the second embodiment of the present invention.
Figure 4:
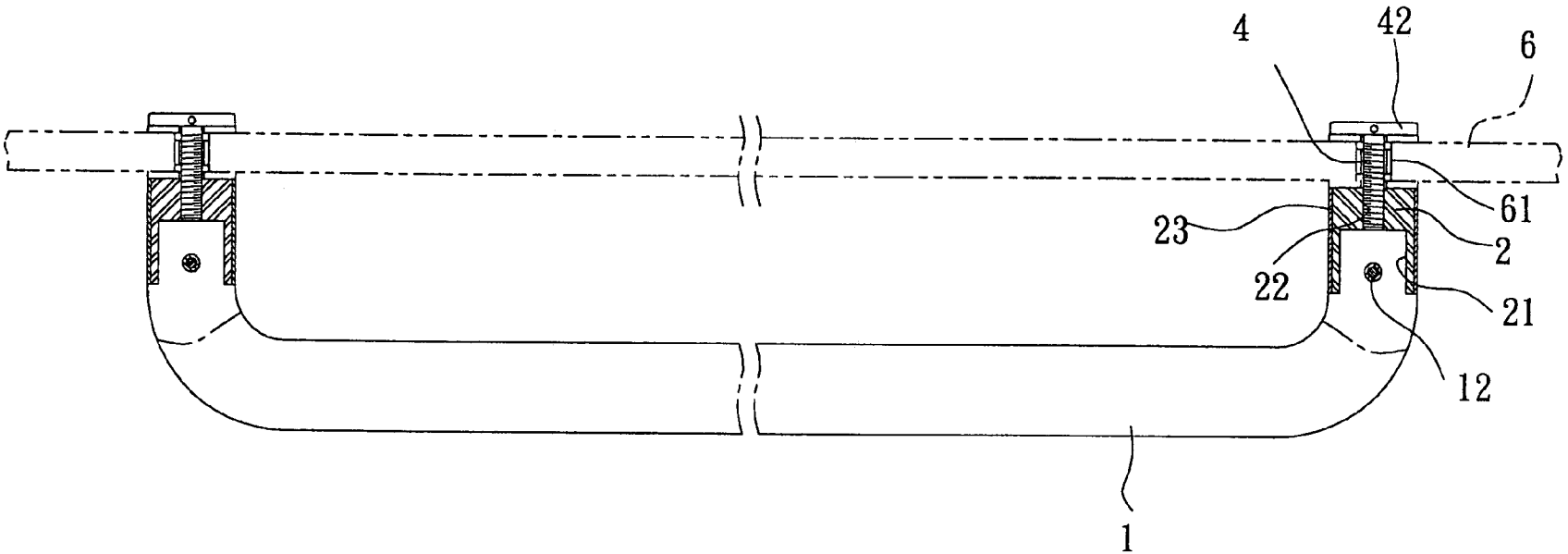
FIG. 4 is a cross-sectional view of the second embodiment of the present invention.

Referring to FIGS. 3, and 4, bolts 4 are screwed into the threaded holes 22 of the connecting blocks 2 of the outward handle part 1 from the inward side of the door 6 according to the second embodiment; thus, the door 6 is only equipped with handle part 1 on the outward side thereof; the bolts 4 are formed with flat heads 42 so as not to spoil the appearance of the handles and the door.

Figure 5:
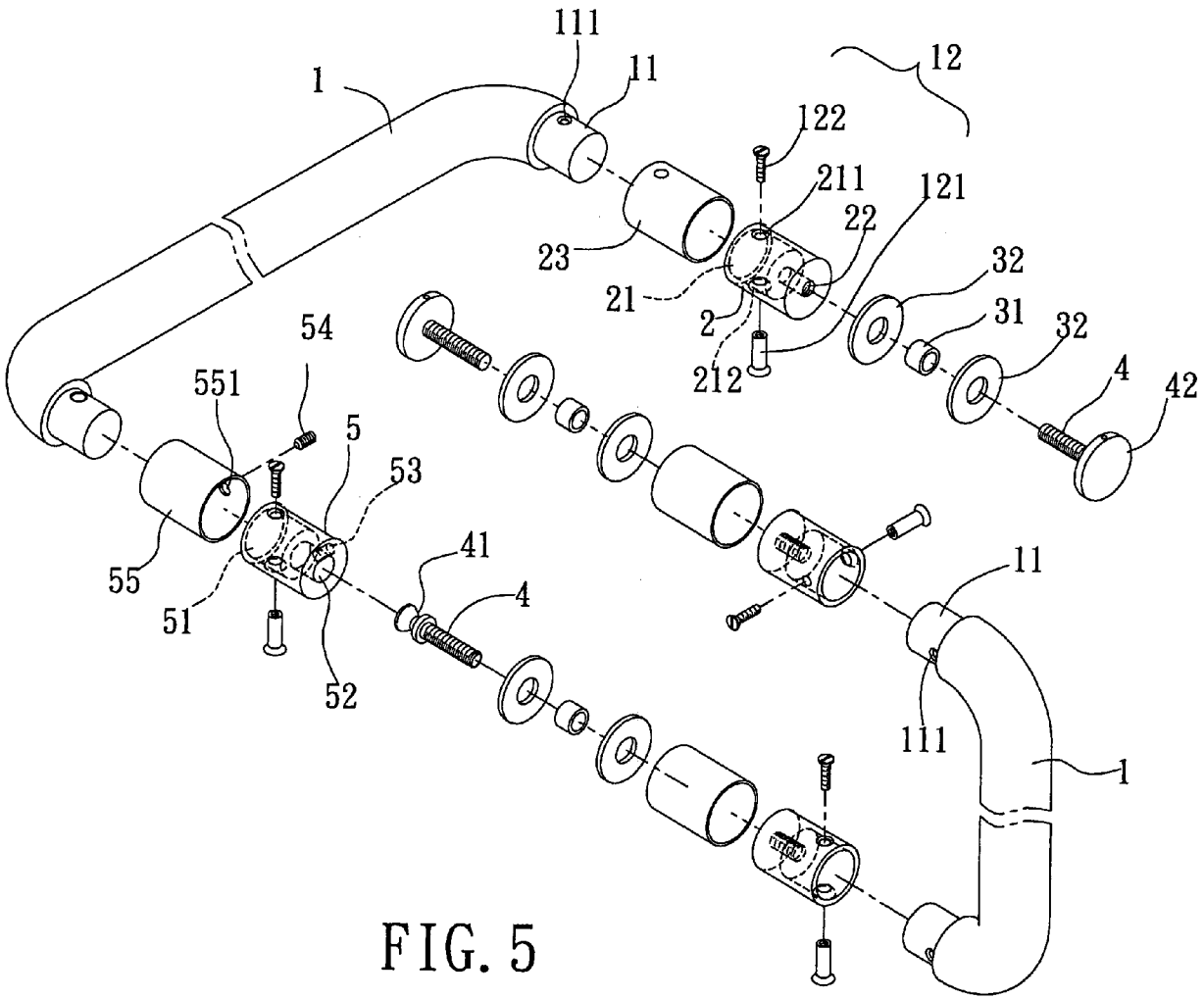
FIG. 5 is an exploded perspective view of the third embodiment of the present invention.
Figure 6:
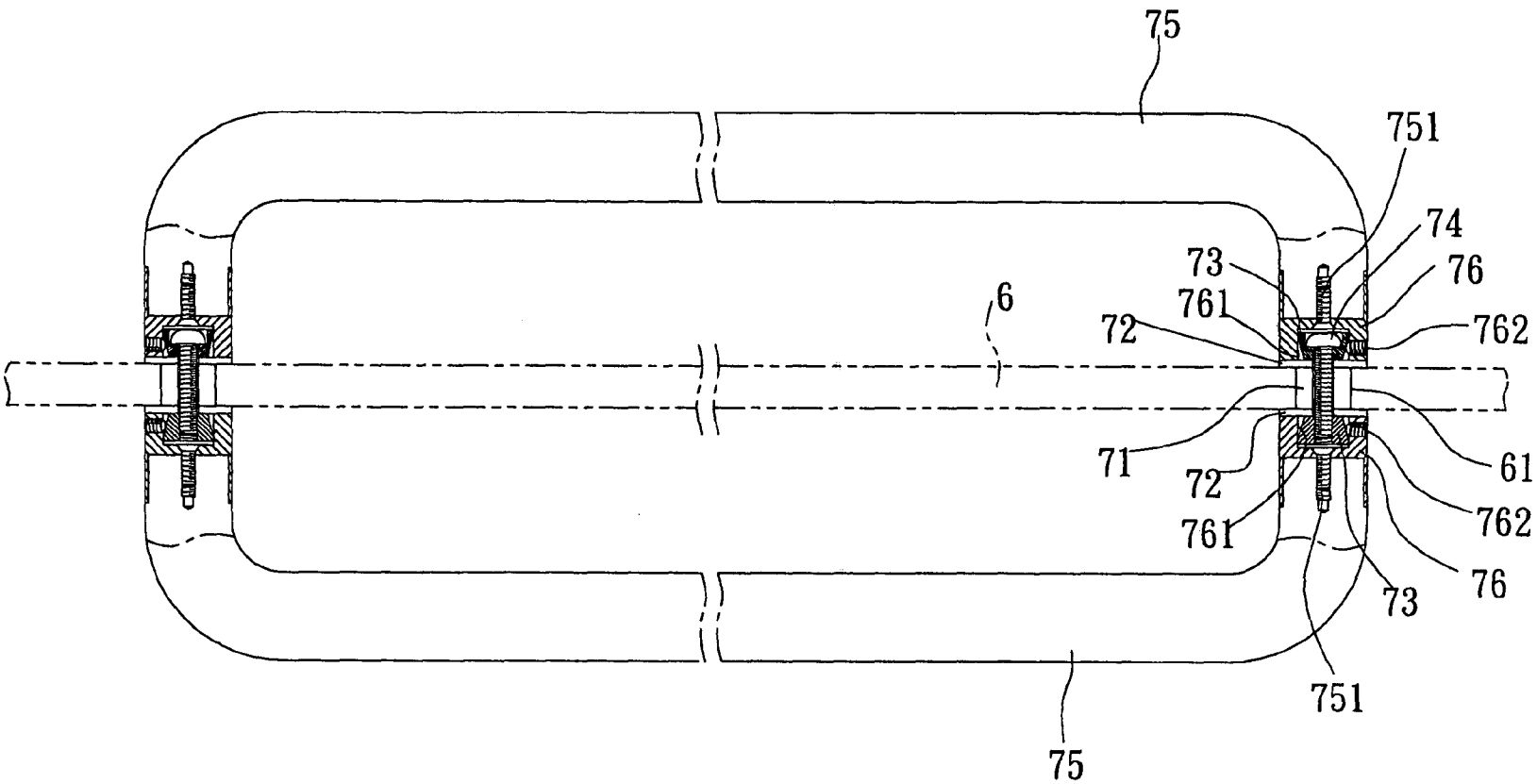
FIG. 6 (PRIOR ART)
FIG. 6 is a horizontal section of the first conventional acrylic handle of a glass door as described in the Background.
Figure 7:
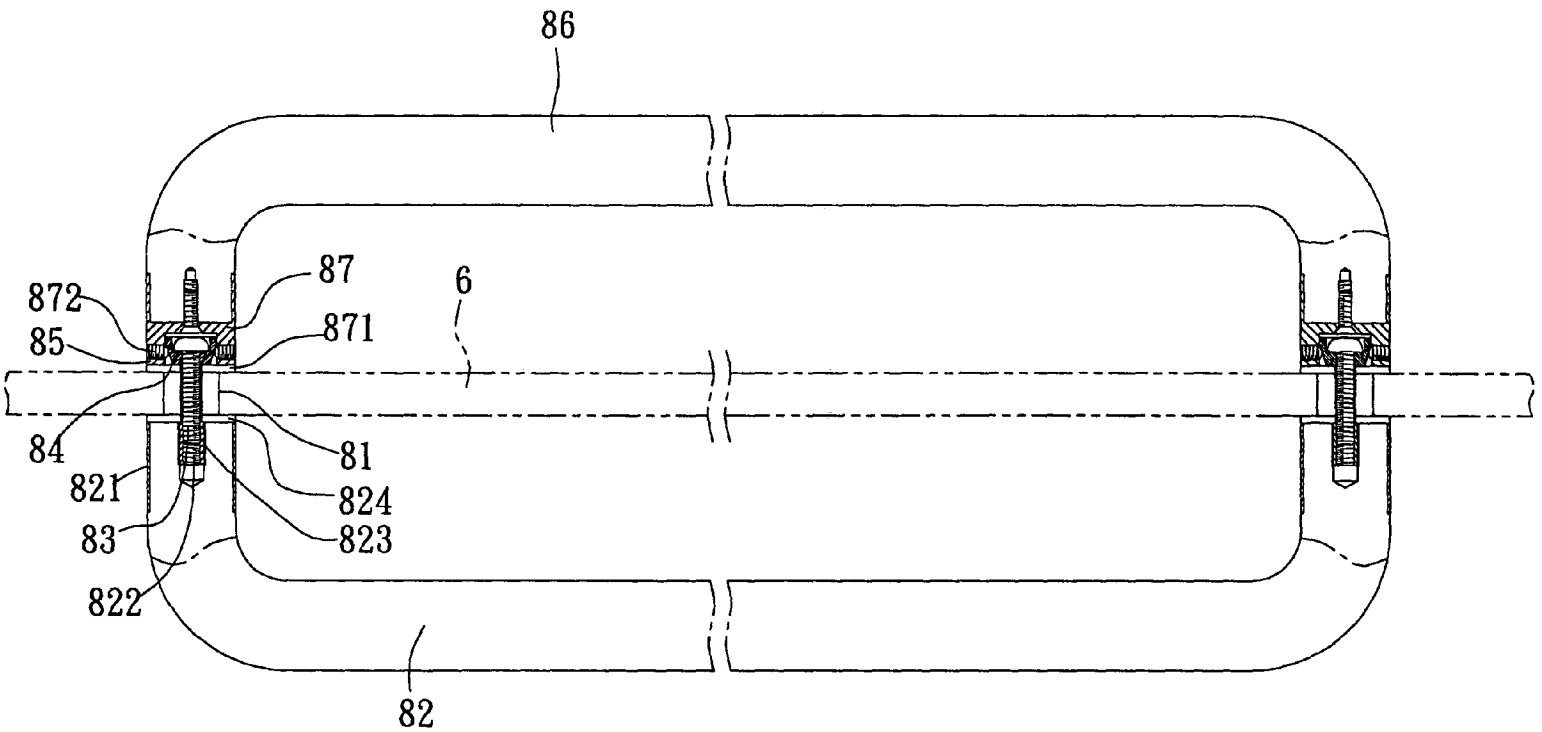
FIG. 7 (PRIOR ART)
FIG. 7 is a horizontal section of the second conventional acrylic handle of a glass door as described in the Background.
Figure 8:
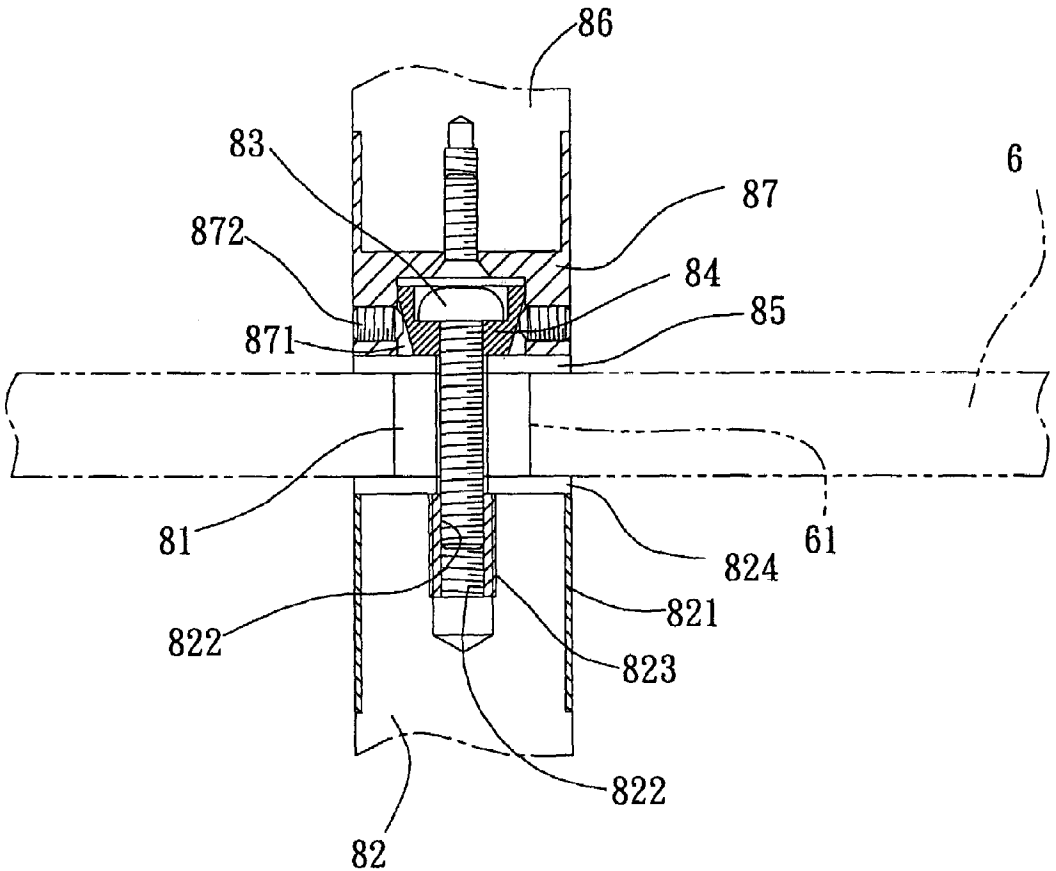
FIG. 8 (PRIOR ART)
FIG. 8 is an enlarged partial horizontal section of the second conventional acrylic handle of a glass door.

Referring to FIG. 5, according to the third embodiment, a glass door can be equipped with inward and outward handle parts 1, 1, which are arranged in horizontal position, and in vertical position respectively so that one of the handles only opposes a first connecting tail end 111 of the other handle at a first connecting tail end 111 thereof; the opposing first connecting tail ends 11 of the handle parts 1, 1 are secured to the door in the same way as the first embodiment; bolts 4 are screwed into threaded holes 22 of connecting blocks 2 that are coupled to second connecting tail ends 11 of the handle parts 1, 1 to secure the handle parts to the door; the bolts 4 are formed with flat heads 42 so as not to spoil the appearance of the handle and the door.

From the above description, it can be easily understood that the acrylic handle set of a glass door in the present invention has advantages as followings:

1. The male and female screws, which are used to secure the connecting blocks 2, and 5 to the handles 1, 1, are passed into the connecting tail ends 11 of the handle parts 1, 1 in the radial direction of the connecting tail ends 11 instead of the axial direction therefore the handles won't be easily damaged or crack due to force exerted to pull the handles to open the door.
2. The connecting blocks are secured to the handle parts 1, 1 by means of connecting elements that allow the handle set of the present invention to be more easily assembled and maintained than the conventional handles which are secured in position by means of the truncated-cone shaped engaging blocks 73, 84, which have to be shaped, formed with threaded holes, and connected to threaded elements by means of special tools and machines.
3. Handle parts are all in the same shape while there are two different kinds of metallic connecting blocks according to the present invention. Therefore, handle parts can be fitted to both sides of the door or either one of inner and outer sides of the door by means of using appropriate ones of two kinds of metallic connecting blocks, and handles fitted to inner and outer sides of the door can be provided with different lengths and at different orientations, e.g. a horizontal one, a vertical one etc., also by means of using appropriate ones of two kinds of metallic connecting blocks. Consequently, the cost of stocking of the handles can be significantly reduced, and the manufacturing and installation of the handles will be easier and have lower cost.

What is claimed is:

1. A handle of a glass door comprising:

an outward handle part disposed on one side of the glass door and having a middle portion and two folded ends, each folded end being formed with a connecting tail end portion, the connecting tail end portion having a radial through hole formed therethrough;

two metallic connecting blocks respectively attached to the connecting tail end portions of the outward handle part, each connecting block having (a) a first end mounted to a corresponding one of the connecting tail end portions, (b) a second opposing end, (c) a holding cavity formed in the first end and receiving the corresponding connecting tail end portion therein, (d) a threaded hole formed in the second end and communicating with the holding cavity, and (e) two radially directed through holes formed adjacent the first end and aligned one with the other and the radial through hole of a respective connecting tail end portion, the two radially directed through holes being in open communication with the holding cavity;

two securing members respectively extending through the aligned radially directed through holes in the connecting blocks and the corresponding connecting tail end portions to securely attach the connecting blocks to the corresponding connecting tail end portions;

two protective tubes respectively sleeved over the connecting blocks; and, two bolts adapted to extend through the glass door and screwed respectively into the threaded holes in the connecting blocks.

2. The handle as claimed in the claim 1, further comprising:

two ringed pads mounted around each of the bolts and disposed on opposing sides of the glass door to clampingly engage the two sides of the glass door; and a tube-shaped pad mounted around each of the bolts and disposed between the two ringed pads on the bolt.

3. The handle as claimed in claim 1, wherein each of the bolts has a flat head to abut the glass door.

4. The handle as claimed in the claim 3, further comprising:

two ringed pads mounted around each of the bolts and disposed on opposing sides of the glass door to clampingly engage the two sides of the glass door; and a tube-shaped pad mounted around each of the bolts and disposed between the two ringed pads on the bolt.

5. The handle as claimed in claim 1, further comprising:

an inward handle part disposed on an opposing side of the door and having a second middle portion and two second folded ends, each of the second folded ends being formed with a second connecting tail end portion, the second connecting tail end portion having a second radial through hole formed therethrough;

two metallic second connecting blocks respectively attached to the second connecting tail end portions of the inward handle part, each second connecting block having (a) a first end mounted to a corresponding one of the second connecting tail end portions, (b) a second end, (c) a second holding cavity formed in the first end and receiving the corresponding second connecting tail end portion therein, (d) a holding hole formed in the second end and communicating with the second holding cavity, (e) two radially directed second through holes formed adjacent the first end and aligned one with the other and the second radial through hole of a respective second connecting tail end portion, the radially directed second through holes being in open communication with the second holding cavity, and (f) a radially directed threaded hole formed adjacent the second end and being in open communication with the holding hole;

two second securing members respectively extending through the aligned radially directed second through holes in the second connecting blocks and the corresponding second connecting tail end portions of the inward handle part to securely attach the second connecting blocks to the corresponding second connecting tail end portions of the inward handle part;

two second protective tubes respectively sleeved over the second connecting blocks on the inward handle part, each of the bolts having (a) a head, (b) a threaded portion extending through the holding hole in a respective second connecting block on the inward handle part and threadedly engaged with the threaded hole in a corresponding connecting block on the outward handle part, and (c) an annular engaging projection formed between the threaded portion and the head; and, a pair of threaded fasteners respectively engaged with the radially directed threaded holes in the second connecting blocks on the inward handle part, each of the threaded fasteners having a distal end abutting the annular engaging projection of a corresponding one of the bolts.

6. The handle as claimed in the claim 5, wherein each of the second protective tubes has a through hole formed radially therein and aligned with the radially directed threaded hole in a respective second connecting block.

7. The handle as claimed in the claim 6, further comprising:

two ringed pads mounted around each of the bolts and disposed on opposing sides of the glass door to clampingly engage the two sides of the glass door; and a tube-shaped pad mounted around each of the bolts and disposed between the two ringed pads on the bolt.

8. The handle as claimed in the claim 5, further comprising:

two ringed pads mounted around each of the bolts and disposed on opposing sides of the glass door to clampingly engage the two sides of the glass door; and a tube-shaped pad mounted around each of the bolts and disposed between the two ringed pads on the bolt.

* * * * *